United States Patent [19]

Jones

[11] 4,032,292

[45] June 28, 1977

[54] METHOD AND APPARATUS FOR BLEACHING AND RELATED PROCESSING OF GREIGE CLOTH

[75] Inventor: Donald K. Jones, Pottstown, Pa.

[73] Assignee: Cluett, Peabody & Co., Inc., New York, N.Y.

[22] Filed: Nov. 8, 1974

[21] Appl. No.: 522,014

[52] U.S. Cl. ..... 8/111; 8/16; 8/101; 8/154; 8/155.1; 68/189

[51] Int. Cl.[2] ..... D06L 3/02; D06L 3/04

[58] Field of Search ..... 8/111, 158, 16, 154, 8/155.1

[56] References Cited

UNITED STATES PATENTS

| | | | |
|---|---|---|---|
| 1,331,743 | 2/1920 | Dudley | 68/185 |
| 1,733,147 | 10/1929 | Brown et al. | 8/155.1 |
| 2,087,308 | 7/1937 | Stienen | 68/27 |
| 2,350,191 | 5/1944 | Raymond | 68/189 |
| 3,145,555 | 8/1964 | Krantz | 68/189 |
| 3,413,080 | 11/1968 | Schlagenhof et al. | 8/137 |
| 3,967,923 | 7/1976 | Ameling | 8/149 |

*Primary Examiner*—Joseph L. Schofer
*Assistant Examiner*—A. L. Clingman

[57] ABSTRACT

The disclosure relates to a high speed process for bleaching greige cloth. The system involves bleaching of the cloth in roll form, in multiple roll batches, utilizing a forced circulation of high temperature liquid bleach at superatmospheric pressures. In the preferred system, a rack, containing a plurality of rolls of greige cloth, is loaded into a pressure vessel. The rack includes means for connecting the several rolls of cloth individually to separate pumps and heat exchangers. Bleaching liquid is pumped through heat exchangers, heated to a high temperature, and thus forced through the rolls. A preferred bleaching material is hydrogen peroxide, but other conventionally used liquid bleaches may also be used in the process. Although the bleach material is introduced into the cloth at a substantially elevated temperature, it is kept from vaporizing by maintaining the bleaching vessel under superatmospheric pressure.

To greatest advantage, a single pressure vessel is utilized, in conjunction with appropriate solution storage vessels, pumps, and valves, to carry out the various related operations associated with the bleaching step, including preliminary impregnation with wetting-out solution, the addition of optical dyes, if desired, washing, the addition of softening solutions and other finishing agents, etc. The invention also contemplates drying of the bleached cloth while it remains in the roll form and still contained in the bleaching vessel, by means of electromagnetic energy.

The new system enables extraordinary reductions in bleaching time to be realized, and also greatly simplifies the related processing. Important savings are realized in equipment and in personnel, as well as in processing time.

6 Claims, 3 Drawing Figures

METHOD AND APPARATUS FOR BLEACHING AND RELATED PROCESSING OF GREIGE CLOTH

BACKGROUND AND SUMMARY OF THE INVENTION

The present invention is directed primarily to the bleaching of greige cloth, and secondarily to the operations normally attendant to the bleaching operation itself. In a conventional, commercial bleaching operation, the greige cloth is first batched into a continuous web of appropriate length, and then is conveyed in "rope" form through a series of operations. Typically, the fabric is directed into a wetting-out solution, which makes the fibers more readily receptive to the bleach solution. The wet-out fabric is then conveyed in a continuous succession through a bleaching kier, "J" box or other vessel, in which it is exposed to the bleaching solution. From the bleaching vessel, the fabric is conveyed to a washing vessel, where it is washed (and/or other finishes are applied), and then to an opening and stretching stage, in which the fabric rope is returned to its initial, flat web form and restored to desired width. The open fabric is then conveyed through a dryer stage and converted to rolled or folded batches of desired length for further handling.

In accordance with the present invention, an improved system and procedure is provided which enables the bleaching and attendant operations to be carried out at greatly increased rates of speed and with less equipment and fewer personnel. In the process of the invention, for example, the fabric bleaching operation may be reduced in time from a conventional period of three to five hours to a period of around 5 to 10 minutes. At the same time, many of the handling problems and production problems experienced in the conventional processing techniques, are avoided.

In accordance with the present invention, the greige fabric, which may be either knitted or woven, is rolled upon a hollow, perforate core tube. In some cases, the fabric may be wound up in the first instance on such a tube as it comes off of the knitting machine or loom. A plurality of the thus wound rolls of fabric are placed in a rack and loaded into a pressure vessel. The rack and vessel, which in themselves may be of known construction, provide for the rolls of fabric to be supported for rotation internally of the vessel, and the perforated core tube for each of the rolls is connected individually to a fluid inlet line.

In accordance with one aspect of the invention, the individual inlet lines to the respective cloth rolls are connected through individual heat exchange units, and individual pumps and valves, to a retention tank for bleach solution. The bleach solution is pumped into the pressure vessel through the individual pumps and heat exchangers, such that the bleach solution is heated after passing through the pumps, and enters the pressure vessel at a substantially elevated temperature. The bleach solution flows into the individual core tubes and then radially outward through the individual rolls of cloth into the interior of the pressure vessel. Desirably, the individual rolls are mechanically rotated while the bleach solution is being flowed therethrough, to provide more effective agitation and distribution of the solution. The pressure vessel has a valved outlet, leading back to the solution retention tank. The valved outlet enables the liquid within the vessel to be controllably maintained under a superatmospheric pressure appropriate to the solution and its temperature, to prevent vaporization of the solution within the vessel.

By effecting a force flow of the bleach solution through the cloth roll, at substantially elevated temperatures relative to conventional processing, and by carrying out the bleaching of the fabric in roll form, it is possible to complete the bleaching of the entire roll within a few minutes, as compared to several hours under conventional procedures.

As a further feature of the invention, the various operations normally attendant to the primary bleaching operation are also carried out while the cloth rolls are housed within the pressure vessel. Thus, prior to introducing the bleach solution, appropriate cleaning and wetting solutions, in conjunction with optical dyes if desired, may be introduced into the cloth by means of the pumps and lines subsequently used for circulating the bleach solution. Likewise, washing operations and the addition of finishing solutions may be introduced through the bleach system, after the bleaching operation has been completed and while the fabric rolls remain within in the processing vessel. Moreover, through the use of radio frequency magnetic energy, by techniques known in the trade and, in themselves, forming no part of the present invention, the wet-processed rolls may be dried while they remain within the processing vessel and in roll form. Thus, pursuant to the invention, dry greige fabric rolls are introduced into the processing vessel, and rolls of dry bleached and finished fabric are removed therefrom after a relative few minutes of processing.

For a better understanding of the above and other features of the invention, reference should be made to the following description of a preferred embodiment thereof and to the accompanying drawings.

DESCRIPTION OF A PREFERRED EMBODIMENT

Figure 1:
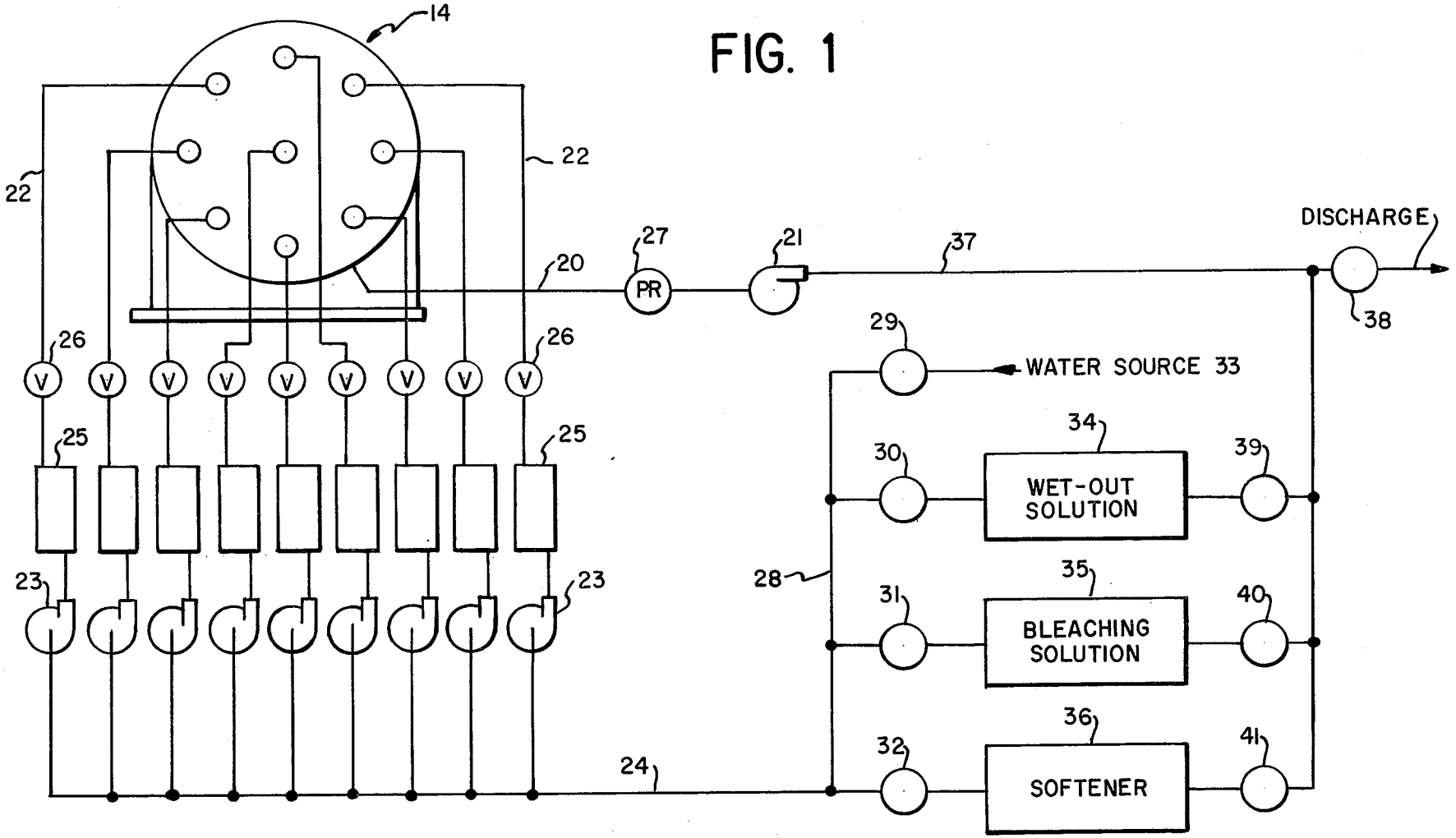
FIG. 1 is a simplified schematic representation of a bleach processing system incorporating the features of the invention.

In the practice of the invention, fabric (typically, but not necessarily knitted fabric) is wound in roll form on a perforated core tube 10. Where convenient, the core tube 10 may be utilized at the knitting or other forming machine, to gather the material as it is constructed. Alternatively, the fabric is rewound in rolls of appropriate diameter on the perforated core tubes. The construction of the core tubes 10, by themselves, does not form part of the present invention and, in general, is well known in the art (see, for example, the Dudley U.S. Pat. No. 1,274,525, Dehnert U.S. Pat. No. 1,513,588, Carrol U.S. Pat. No. 2,912,298, Wilcox U.S. Pat. No. 3,596,481).

In the practice of the invention, a plurality of rolls 11 of fabric, previously wound on the perforated core tubes 10, are placed on a movable rack assembly, generally designated by the reference numeral 12. In a typical embodiment of the invention, the rack 12 may include a substantial plurality (e.g., nine in the illustration) of roll supporting spindles 13, which receive and support the loaded core tubes 10. After the rack 12 is fully loaded, it is advanced on its wheels 12*a* into a side-opening pressure vessel, generally designated by the reference numeral 14. The pressure vessel includes a hinged sealing door 15, which is opened to admit the rack 12 and is then closed behind it and locked, to enable the chamber to be pressurized with the rack inside it. The structural details of the pressure vessel are in general known and do not constitute part of the present invention, see, for example, the Wilcox U.S. Pat. No. 3,596,481, previously referred to, the Bellmann U.S. Pat. No. 2,872,802, and the Steiger U.S. Pat. No. 2,086,100.

At the closed end 16 of the pressure vessel 14 there are provided a plurality of rotatable fluid couplings 17 arranged and disposed to join with the exposed ends 18 of the core tubes, when the rack 12 is fully received within the pressure vessel. The arrangement is such that the core tubes are both mechanically and hydraulically coupled to the fluid couplings. Accordingly, fluid may be directed into the interior of the core tubes and caused to flow radially outward through the fabric roll, in a manner generally well known in the art of beam dyeing, for example. The several fluid couplings 17 are connected by gears 19 or other means and are arranged to be rotatably driven by a motor 20. When the core tubes 10 are joined with the fluid couplings, the couplings and the rolls 11 of the fabric may be rotated while fluid is being admitted into the core tubes, to provide a more uniform flow of processing solution through the fabric roll.

In accordance with general aspects of the invention, after a plurality of rolls 11 of greige fabric have been placed within the pressure chamber 14, the fabric may be exposed to various processing solutions typically associated with the bleaching process. In this respect, suitable cleaning and wetting-out solutions may be first introduced through the fluid couplings 17 and circulated through the fabric. The solutions introduced through the fluid couplings 17 are withdrawn through an outlet line 20 and returned by a pump 21 to a holding tank for the solution.

After completing the cleaning and wet-out procedure, bleaching solution is introduced and circulated through the fabric, in a manner to be hereinafter more fully described. The bleach solution is typically followed by wash water, which flushes out dirt and spent bleach solution, and the water wash may be typically followed by the introduction of a fabric softener, bluing agent or the like.

Desirably, drying of the fabric is accomplished while it remains in the pressure vessel 14. To this end, the last processing solution is removed, and the fabric is dried in roll form by radio frequency energy. The techniques for drying by radio frequency energy are, in themselves, well known and do not form part of the invention. However, the technique lends itself advantageously to the overall process incorporating the underlying inventive concepts.

In accordance with a significant aspect of the invention, separate fluid inlet lines 22 are provided leading to the individual rotary fluid couplings 17. Each of the fluid inlet lines 22 is connected to an individual pump 23, the respective intakes of which are connected to a common feeder line 24. The discharge sides of the individual pumps 23 are connected to the fluid lines 22 through individual heat exchange units 25 and individual flow control valves 26. The arrangement is such that processing solution delivered through the common supply header 24, passes through a separate heat exchange unit, before being discharged into the roll of fabric within the pressure vessel.

At the outlet or discharge side of the pressure vessel 14, a controllable pressure regulator valve 27 is provided on the upstream side of the return pump 21, so that the pressure within the vessel 14 may be controllably regulated.

In accordance with the invention, bleach solution is supplied to the pressure vessel at a temperature substantially above conventional bleaching temperatures, enabling the bleach to react with the fabric extremely rapidly, such that the bleaching operation can be completed in a few minutes. In conjunction with the substantially increased temperature of the bleach solution, the pressure under which the solution is maintained is appropriately increased, relative to the ambient, to prevent vaporization of the bleach solution, at least within the processing vessel 14. The flow of bleaching or other solution to the individual fabric rolls can be individually regulated, by means of the respective individual control valves 26, so that a properly balanced flow of processing solution to the individual rolls is achieved. If necessary, or appropriate, suitable flow metering means (not shown) could be provided in the fluid inlet lines 22.

With reference to FIG. 1, the supply header 24 is shown to be connected, through a line 28 and individual control valves 29–32, to a plurality of sources of processing fluids. In the illustrated system, the several processing solutions are indicated to be a water supply 33, and holding tanks 34–36 for wet-out solution, bleaching solution and softener or other finishing solution. By appropriate operation of the valves 29–32, any of the sources may be connected to the supply header 24. In a like manner, a discharge line 37, leading from the discharge pump 21 may be connected through valves 38–41, either to discharge or to the various solution retaining tanks. Thus, during the wetting-out stage, for example, the valves 30, 39 may be opened, to permit wetting-out solution to be delivered to the supply header 24 and be pumped individually to the plurality of rolls of greige material within the pressure vessel. The solution is then discharged by the pump 21, through the line 37 and valve 39 back into the retaining tank 34. The solution may be recirculated until it is spent. When appropriate, any of the solutions may be directed to discharge, by opening of the valve 38.

In a bleaching process according to the invention, the bleach solution typically may be hydrogen peroxide solution, although the invention contemplates the utilization of other conventional liquid bleach solutions such as sodium hypochlorite, persulphate, or the like. The hydrogen peroxide solutions, conventionally utilized at a temperature of around 80° F is, in accordance with the invention, heated by the individual heat exchange units 25 to a temperature of around 160° F minimum, up to as high as around 300° F. To avoid vaporization and/or decomposition of the bleach, while it is maintained at these elevated temperatures, the process of the invention includes maintaining of the bleach solution under such pressure as may be necessary to prevent vaporization at the temperature utilized. This is achieved by control of the pressure regulating valve 27 in the discharge line 20. Typically, pressures up to 100 psig may be utilized in the bleaching operation, where the bleach is introduced in the higher end of the specified temperature range. Where the bleach is supplied at the lower end of the temperature range, little if any pressurization of the vessel 14 is required to avoid vaporization. The appropriate correlation of bleach temperature and pressure, with specific bleaching solutions, may be readily determined with minimum experimentation.

Figure 3:
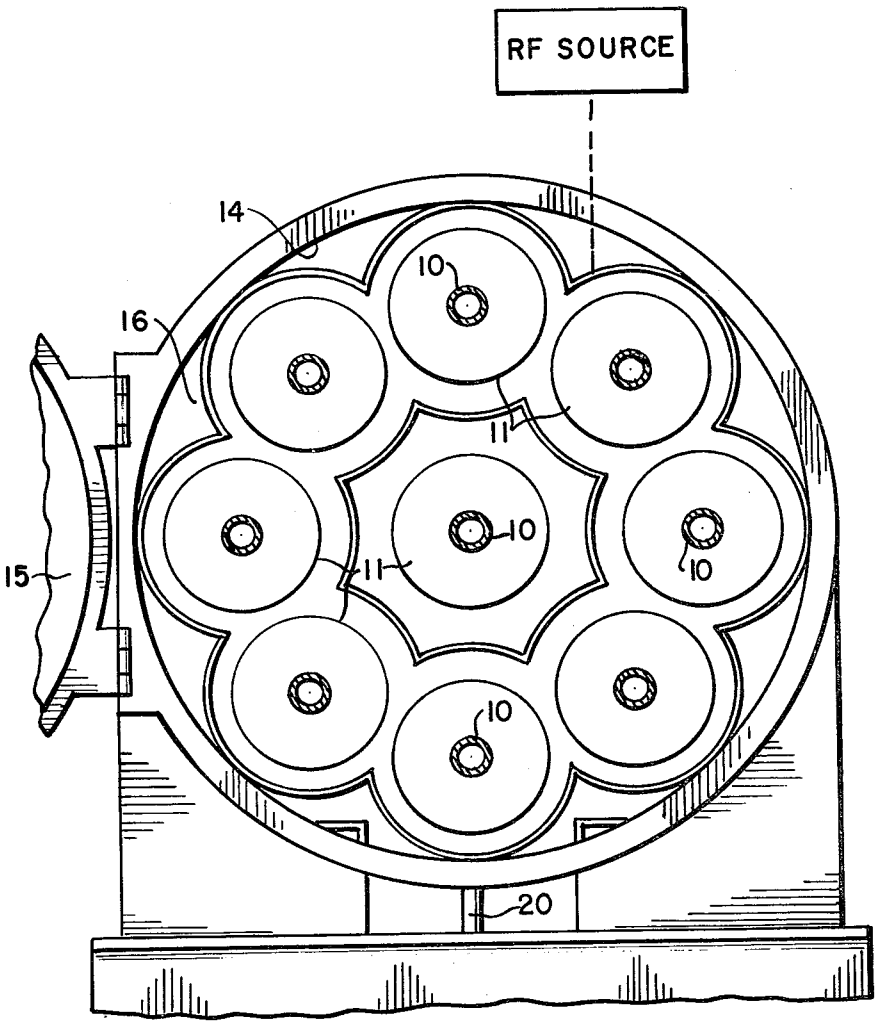
FIG. 3 is an illustration in transverse cross section of a pressure vessel and related equipment utilized in the practice of the invention as reflected in FIG. 1.

In a complete process according to the invention, a plurality of rolls 11 of fabric, either initially constructed or subsequently rewound on the perforated core tubes 10, are loaded onto the movable rack 12. To advantage, a rack 12 of suitable proportions may contain nine rolls, arranged in a configuration shown in FIG. 3 and a typical roll may contain about forty pounds of fabric. The rack 12 is wheeled into position within the pressure vessel 14, and the several perforated core tubes become mechanically and hydraulically joined to the rotary fluid couplings 17. The pressure chamber door 15 is then closed and clamped, and the processing commenced.

Typically, the first processing stage for greige cloth involves introducing a washing and wetting-out solution. This may be accomplished by opening of the valves 30, 39 and energizing of the individual pumps 23, as well as the return pump 21. The back pressure setting of the pressure regulator valve 27 will be at a minimum setting. The wetting-out solution is thus pumped through the individual fabric rolls while the latter are being rotated. The solution is recirculated back to the storage vessel 34, and may be recirculated and reused in more than one processing operation, until spent. Typically, the wet-out phase may continue for approximately 1 to 3 minutes. If desired, an optical dye may be introduced into the cloth during the wetting-out phase of the process.

When the fabric has been adequately wet-out, the valve 30 is closed, and the remaining liquid is pumped back to the solution tank 34.

Figure 2:
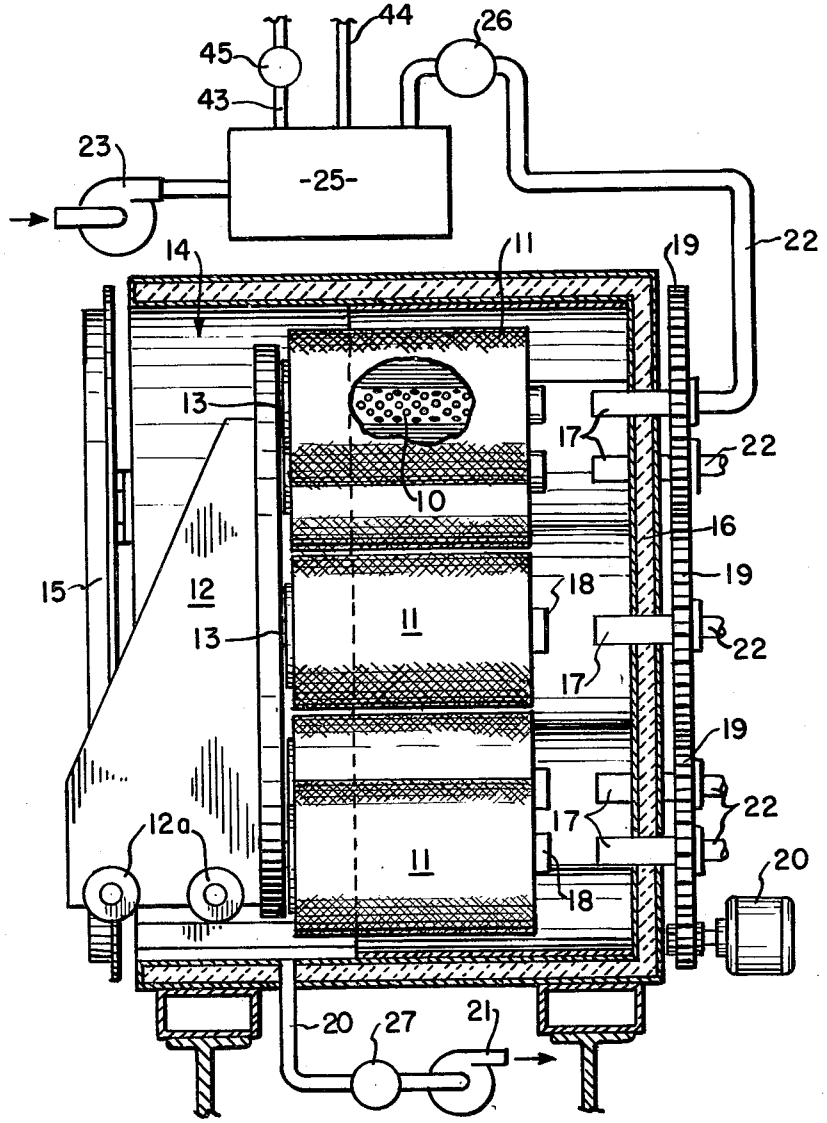
FIG. 2 is an illustration in longitudinal cross section of a pressure vessel and related equipment utilized in the practice of the invention as reflected in FIG. 1.

After the wet-out phase, bleaching solution may be introduced by closing off the return valve 39 to the retention tank 34 and opening valves 31, 40 to the bleaching solution tank. The pressure regulator valve 27 is adjusted to set the back pressure within the pressure vessel 14 at the desired level for the process conditions. Pursuant to the invention, at this stage the individual heat exchange units 25 are activated by the introduction of steam from a suitable source, through lines 43, 44 and valves 45 (FIG. 2). The individual heat exchangers, which are located downstream of the individual pumps 23, have a sufficient heat exchange capacity to heat the flowing bleach liquid up to a temperature level of between about 160° F and about 300° F, and the high temperature solution is introduced into the perforated core tubes 10 and forced through the rotating fabric rolls 11. The used bleach solution flows through the back pressure valve 27 and is pumped back to the storage vessel 35, from which it may be recirculated until spent. The bleach solution returning to the solution tank 35 loses much of its heat prior to the time that it is recirculated. Thus, the bleach solution flowing through the pumps 23 is maintained at a relatively low temperature, and is in all cases heated by the heat exchangers 25 at the downstream side of the pumps, immediately prior to the introduction into the fabric. The temperature of the bleach solution leaving the heat exchangers 25 may be controlled by means such as individually controllable valves 45 in the steam lines 43.

Typically, the bleaching phase of the process, as carried out according to the invention, may involve a period of approximately 5 to 10 minutes during which a typical quantity of bleaching solution amounting to about one to three times the weight of the fabric will have been pumped through a fabric roll (i.e., approximately 40–120 pounds of bleach solution will be pumped through a typical roll of 40 pounds).

At the end of the bleaching phase, rinse water may be introduced into the system by closing off the bleach supply valve 31 and opening a valve 29 connected to a water source 33. As water is introduced, the displaced bleach solution may initially be returned to the bleaching solution tank 35, after which valve 38 will be opened to discharge, and valve 40 to the bleaching solution tank will be closed. If desired, the rinse water may be heated, (as may any of the other processing solutions) by activation of the heat exchangers 25. However, it is preferred to activate the heat exchangers (and to utilize back pressure in the vessel 14) only during the bleaching phase. The wash water typically is circulated about 3 to 5 minutes, removing dirt and spent solution from the fabric until the action of the bleach is effectively terminated. Thereafter, the water valve 29 may be closed, and valve 32, to the tank 36 may be opened. This tank contains fabric softener, bluing, and perhaps other finishing agents; these are circulated through the pumps 23 to the individual rolls within the pressure vessel. Typically, the back pressure valve 27 will have been readjusted to minimum pressure setting following the bleaching operation, and may remain at such minimum pressure adjustment during the circulation of the softening agent. Alternatively, the back pressure valve may be by-passed after the bleaching stage. The initial flow of the softener will displace rinse water, which can be directed through the discharge valve 38, after which the valve 38 is closed, and the softener return valve is opened to direct the recirculation of the softening solution of the tank 36. Typically, the softening solution may be recirculated for a period of approximately 3 to 5 minutes.

The process of the invention admits of carrying out not only the bleaching operation but the various related processing phases while the fabric remains in roll form within the pressure vessel 14. To this end, the invention further contemplates the utilization of radio frequency energy to dry the fabric rolls while they remain within the pressure vessel 14. For this purpose, the pressure vessel 14 may be provided with a radiating grid 46 coupled with a suitable radio frequency source 47. The technique for radio frequency drying is known in the art, and does not, of itself, constitute a part of this invention. However, utilization of the technique as part of the overall process of performing bleaching and related operations on roll-form fabric while contained within a pressure vessel is considered to have important advantages and the advantageous overall process is considered to be one of the inventive features hereof.

In a typical process according to the invention, the drying operation may require a period of about 10 to 15 minutes. During this period, the vessel door 15 is opened or the vessel 14 is otherwise ventilated to remove vapors.

The process and apparatus of the invention enable extraordinary improvements to be realized in the processing time required for bleaching and related procedures, resulting in significant savings. For example, the bleaching phase by itself may be accomplished in a period of 5 to 10 minutes, as compared to 3 to 5 hours by conventional procedures. Perhaps more significantly, the bleaching and attendant operations, including wetting-out, bleaching, washing, addition of finishing agents, and drying may be accomplished in a period from about 20 to 40 minutes; under conventional procedures, a period of about 12 to 15 hours would be required to carry out the corresponding processing activity. Moreover, the process of the invention results in significant reduction in personnel requirements. By way of example, in a 2 thousand roll per day commercial bleaching operation practiced according to the invention, there is a personnel requirement of about 10 men. By comparison, a conventional bleaching operation of similar capacity requires approximately 40 men. In addition, conventional processing can introduce undesired distortions and defects into the fabric by reason of its being handled in rope and web form, as distinguished from being processed in roll form pursuant to the invention.

A significant feature of the invention, resides in the underlying concept of conducting the bleaching operation upon multiple rolls of fabric, utilizing the bleach at a substantially elevated temperature. This is made practical by providing, for each of the rolls of a multiple roll batch, an individual pump and heat exchanger, such that each of the rolls is subject to individual control of the flow of processing solution.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim

1. A method for bleaching fabric in batches, comprising the steps of a. forming the fabric into batches;

b. placing the batches in a pressure vessel;

c. supplying pressurized treating fluid directly to said batches; the improvements characterized by the steps of d. dividing said treating fluid supply into individual portions for each said batch;

e. pressurizing each individual portion for each individual batch;

f. after said pressurizing step, heating each said pressurized portion;

g. after said heating step, passing each heated pressurized portion individually into said pressure vessel and through one of said individual batches;

h. adjusting separately the individual pressurization of each individual pressurized portion to provide uniformity of flow through said batches;

i. withdrawing said treating fluid from said pressure vessel; and j. continuously circulating said withdrawn treating fluid through said dividing, pressurizing, heating and passing steps until said fabric is treated.

2. The method of claim 1, further characterized by a. said treating fluid is hydrogen peroxide;

b. said pressurizing step is carried out by pressurizing said hydrogen peroxide to a pressure of up to about 100 psig; and c. said heating step is carried out by heating each individual pressurized portion of hydrogen peroxide to a temperature within the range of between about 160° and 300° F.

3. The method of claim 1, further characterized by a. said fabric being greige fabric in an elongated web;

b. said batches being formed by winding said web in rope form onto individual perforated hollow core tubes; and c. said passing step being carried out by introducing said treating fluid centrally of said hollow core tubes.

4. The method of claim 2, further characterized by a. said passing step being carried out by passing within the range of between about 1 and 3 pounds of hydrogen peroxide per pound of fabric through each said batch.

5. The method of claim 1, further characterized by a. said treating fluid including individual supplies of wetting-out solution, bleaching solution and finishing solution for the sequential supply thereof to said batches;

b. each of said individual supplies being divided sequentially into individual portions for said batches;

c. each of said individual portions of said individual supplies being pressurized for each individual batch;

d. each individual pressurized portion of said individual supplies of treating solution being passed to its respective batch; and e. each said individual portion of said pressurized bleaching solution being heated in said heating step prior to being passed to said batches while said individual portions of said wetting-out solution and said finishing solution are passed directly from said pressuring step to said batches.

6. The method of claim 1, further characterized by a. after said continuously recirculating step, drying said batches in said pressure vessel, and b. said drying step being carried out by applying radiant energy.

* * * * *